US006357370B1

(12) United States Patent
Fritz et al.

(10) Patent No.: US 6,357,370 B1
(45) Date of Patent: Mar. 19, 2002

(54) METHOD OF MAKING A QUILTED BORDER, QUILTING BORDERS, AND QUILTING BORDER KIT

(75) Inventors: Christine Fritz; Wendy Lloyd-Davies, both of Coeur d'Alene, ID (US)

(73) Assignee: Quilting Made Easy, Inc., Coeur d'Alene, ID (US)

( * ) Notice: Subject to any disclaimer, the term of this patent is extended or adjusted under 35 U.S.C. 154(b) by 0 days.

(21) Appl. No.: 09/572,638

(22) Filed: May 17, 2000

Related U.S. Application Data

(60) Provisional application No. 60/168,338, filed on May 16, 1999.

(51) Int. Cl.[7] ..... D05B 11/00; D05B 97/12; A41H 3/00

(52) U.S. Cl. ..... 112/475.01; 112/117

(58) Field of Search ..... 112/475.01, 475.08, 112/117; 428/57, 102; 156/93, 63; 33/137 R, 1 B, 1 G, 11, 12, 15, 14, 16, 17 R

(56) References Cited

U.S. PATENT DOCUMENTS

| | | | | |
|---|---|---|---|---|
| 778,162 A | | 12/1904 | Wulle | |
| 889,614 A | * | 6/1908 | Johnsen | 112/439 |
| 1,067,923 A | | 7/1913 | Jefferson | |
| 3,621,579 A | | 11/1971 | Dubitsky | |
| 3,797,120 A | | 3/1974 | Byne | |
| 4,053,986 A | * | 10/1977 | Axelrod | 33/17 R |
| 4,386,980 A | | 6/1983 | Fitzpatrick et al. | |
| 4,646,666 A | * | 3/1987 | Burrier | 112/439 |
| 5,282,317 A | * | 2/1994 | Carter et al. | 33/1 B |
| 5,617,802 A | | 4/1997 | Cash | |
| 5,635,001 A | | 6/1997 | Mahn, Jr. | |
| 5,650,211 A | | 7/1997 | Randolph | |
| 5,749,149 A | * | 5/1998 | Claytor | 33/1 G |
| 5,836,023 A | | 11/1998 | Munson | |

* cited by examiner

*Primary Examiner*—Ismael Izaguire
(74) *Attorney, Agent, or Firm*—Michael Best & Friedrich LLC

(57) ABSTRACT

The present invention provides a kit of parts for quilting a border, a border pattern, and a method of making a quilted border. The method includes the steps of preparing a quilt for quilting on a substantially flat surface, layering a backing, a batting, and a quilt top, basting or pinning the backing, batting and quilt top, quilting a center area of the quilt, pinning a corner pattern at two adjacent corners of the quilt top, measuring and cutting a removable border pattern having border pattern indicia on a top surface of the removable border pattern and at least two substantially parallel removable self-adhesive strips on a bottom surface of the removable border pattern to a size to fit between the corner patterns, aligning the border pattern to be substantially aligned with the corner patterns, removing a covering from the removable self-adhesive strips, applying the removable border pattern to the quilt at a desired location, stitching the removable border along the indicia, and removing the removable border pattern from the quilt.

18 Claims, 11 Drawing Sheets

BORDERS MADE EASY

*Adhesive Backed Patterns For Continuous Machine Quilting*

PLEASE READ ALL INSTRUCTIONS BEFORE BEGINNING

-Prepare your quilt for quilting on flat surface:

-Layer backing, batting and quilt top. Make sure backing and batting extend 1 1/2" - 2" (recommended) beyond the edge of quilt top. Baste or pin. If you need more instructions on this step, please consult a quilting book.

-Quilt center area of your quilt before starting borders. To prevent shifting, baste 1/4"-1/2" from outside edge of quilt top -Remove Corner Patterns from core, cut apart on line indicated. Pin at two adjacent corners of your quilt top.

-Measure and cut Border Pattern length to fit between Corner Patterns, align Border Pattern so it meets Corner Pattern, making sure dotted and solid lines match where applicable (to match Border Pattern to Corner Pattern, you may need to cut pattern at dotted line and lengthen or shorten as needed. See illustration below). If you are not able to complete stitching your border in one session, we suggest working on one or two border sides at a time rather than applying the Border Pattern around your entire quilt.

NOTE: When placing BORDERS MADE EASY on outside border of quilt top, be sure to consider seam allowance for binding.

-Remove adhesive backing and position Border Pattern in desired location on quilt. For pattern #103, place the Border Pattern on quilt so the BORDERS MADE EASY logo is towards the outside edge of the quilt. Also, if you are not sewing both the solid and dashed lines on the pattern, you must align the corner with the border so you will follow either the dashed or solid line all around the Border Pattern. Do not leave adhesive pattern on quilt longer than 48 hours or the adhesive may transfer to your fabric. Do not iron BORDERS MADE EASY, or stitch through the adhesive strips.

-Stitch using desired stitch length on dashed and/or solid lines of pattern to obtain desired border width. For pattern #101, stitch on all solid lines for 3" wide border and on dashed lines for 1 3/4" wide border -Carefully tear away paper. Congratulations! Wasn't that easy?

TO LENGTHEN PATTERN:
Cut on dotted line and elongate one or more sections to make Border Pattern fit between Corner Pattern

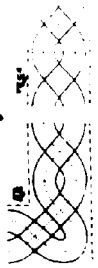

TO SHORTEN PATTERN:
Cut on dotted line and overlap one or more sections to make Border Pattern fit between Corner Pattern

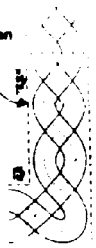

FIG. 6

METHOD OF MAKING A QUILTED BORDER, QUILTING BORDERS, AND QUILTING BORDER KIT

This application claims benefit of provisional application 60/168,338, filed May 16, 1999.

BACKGROUND OF THE INVENTION

The invention generally relates to a method of making a quilted border, quilting borders, and quilting border kit. Making quilting borders is difficult using conventional methods or products. It is an object of the present invention to solve the problems associated with the conventional systems and methods.

SUMMARY OF THE INVENTION

The present provides a method of making a quilted border comprising preparing a quilt for quilting on a substantially flat surface, layering a backing, a batting, and a quilt top, basting or pinning the backing, batting and quilt top, quilting a center area of the quilt, pinning a corner pattern at two adjacent corners of the quilt top, measuring and cutting a removable border pattern having border pattern indicia on a top surface of the removable border pattern and at least two substantially parallel removable self-adhesive strips on a bottom surface of the removable border pattern to a size to fit between the corner patterns, aligning the border pattern to be substantially aligned with the corner patterns, removing a covering from the removable self-adhesive strips, applying the removable border pattern to the quilt at desired location, stitching the removable border along the indicia, and removing the removable border pattern from the quilt.

In yet another embodiment, the invention provides a kit of parts for application of a quilted border indicia, comprising of at least four corner patterns having corner border indicia on at least one surface of the corner patters, and a substantially continuous length of removable border pattern having border pattern indicia on a top surface of the removable border pattern and at least two substantially parallel removable self-adhesive strips on a bottom surface of the removable border pattern, the corner indicia being arranged on the removable border pattern to be alignable with border pattern indicia.

In yet another variant, the invention provides a substantially continuous length of quilting border pattern comprised of a border pattern indicia on a top surface of the quilting border pattern and at least two substantially parallel removable self-adhesive strips on a bottom surface of the removable border pattern optionally continuously arranged at edges of the quilting border pattern, the border pattern indicia being arranged in a substantially repeating manner and alignable with corner indicia on a corner pattern.

The objects and features of the present invention, other than those specifically set forth above, will become apparent in the detailed description of the invention set forth below.

BRIEF DESCRIPTION OF THE DRAWINGS

FIG. 6 illustrates an instruction sheet related to the method of the present invention;

DETAILED DESCRIPTION OF THE INVENTION

Figure 1:
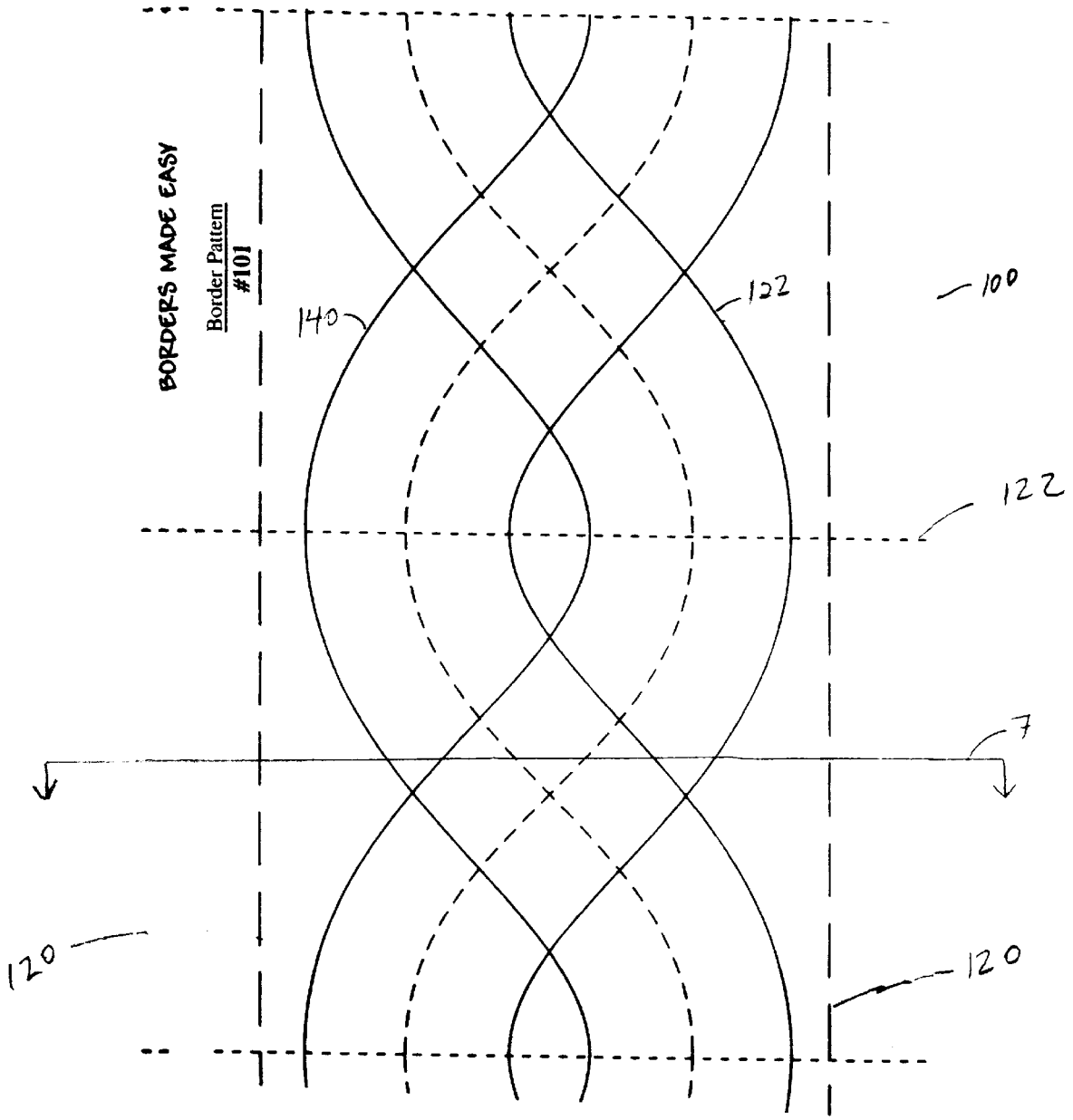
FIG. 1 is a top view of a section of removable border of the present invention.
Figure 2:
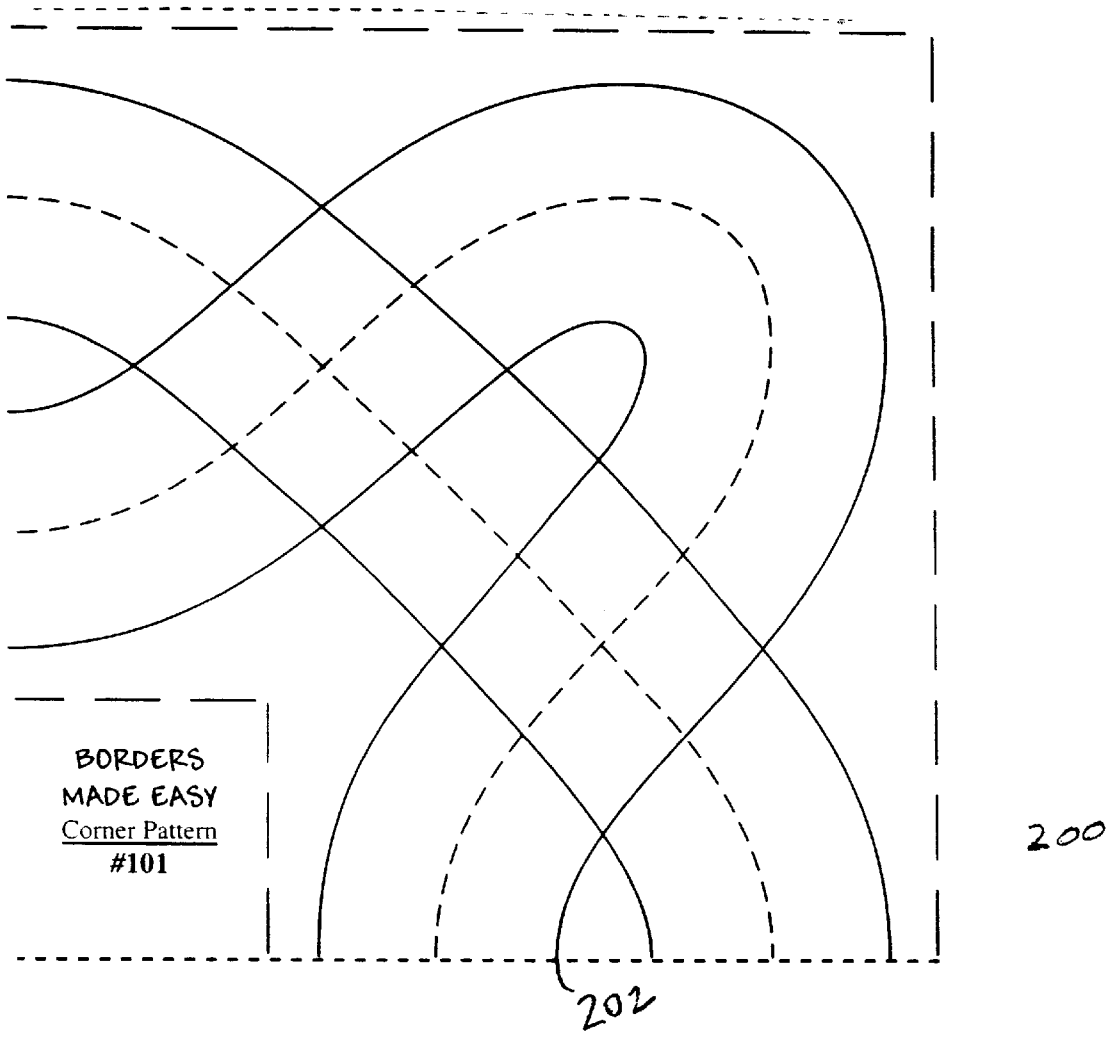
FIG. 2 is a top view of a corner border of the present invention.
Figure 3:
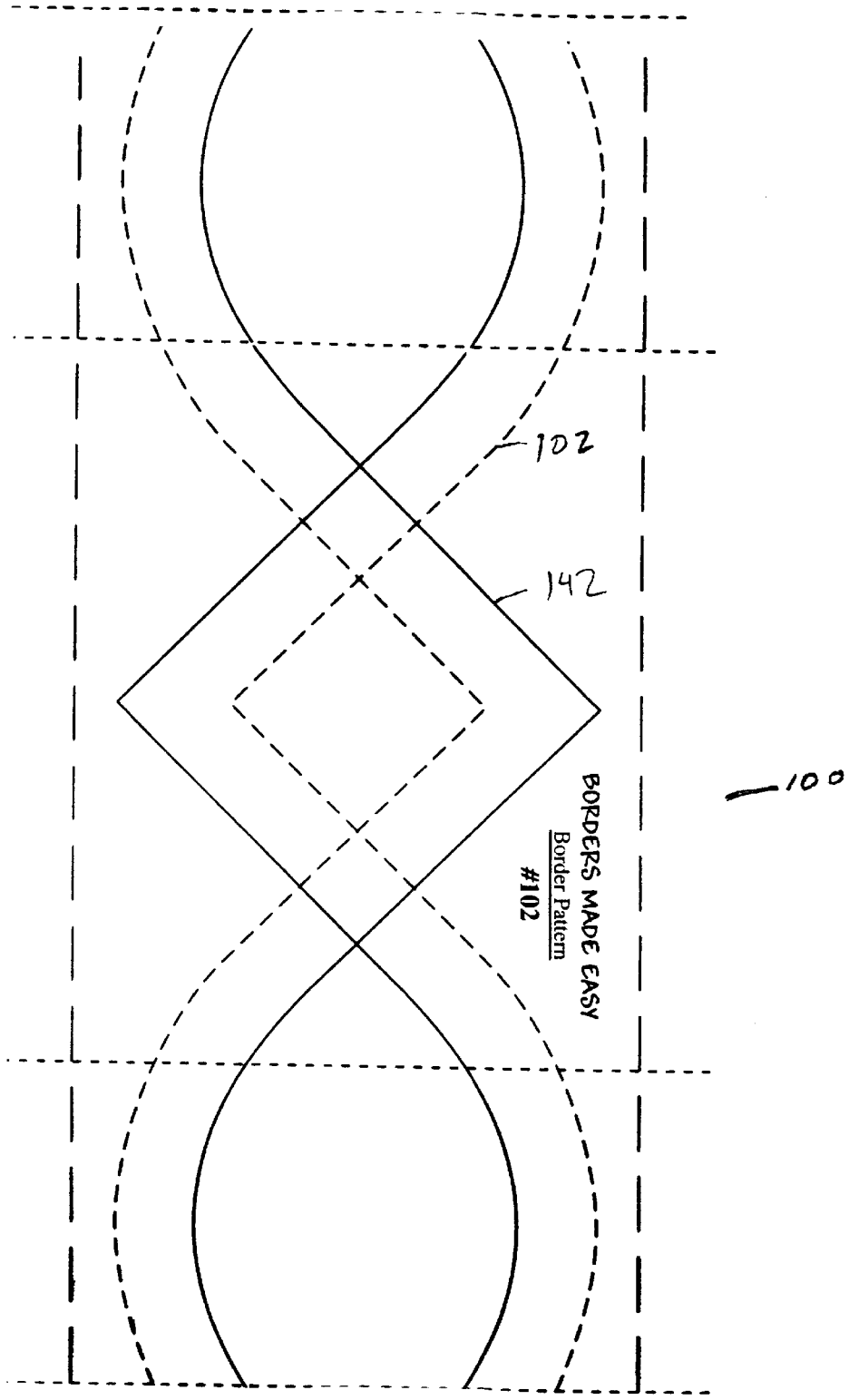
FIGS. 3–5 illustrate top views of other embodiments of the removable border of FIG. 1.
Figure 4:
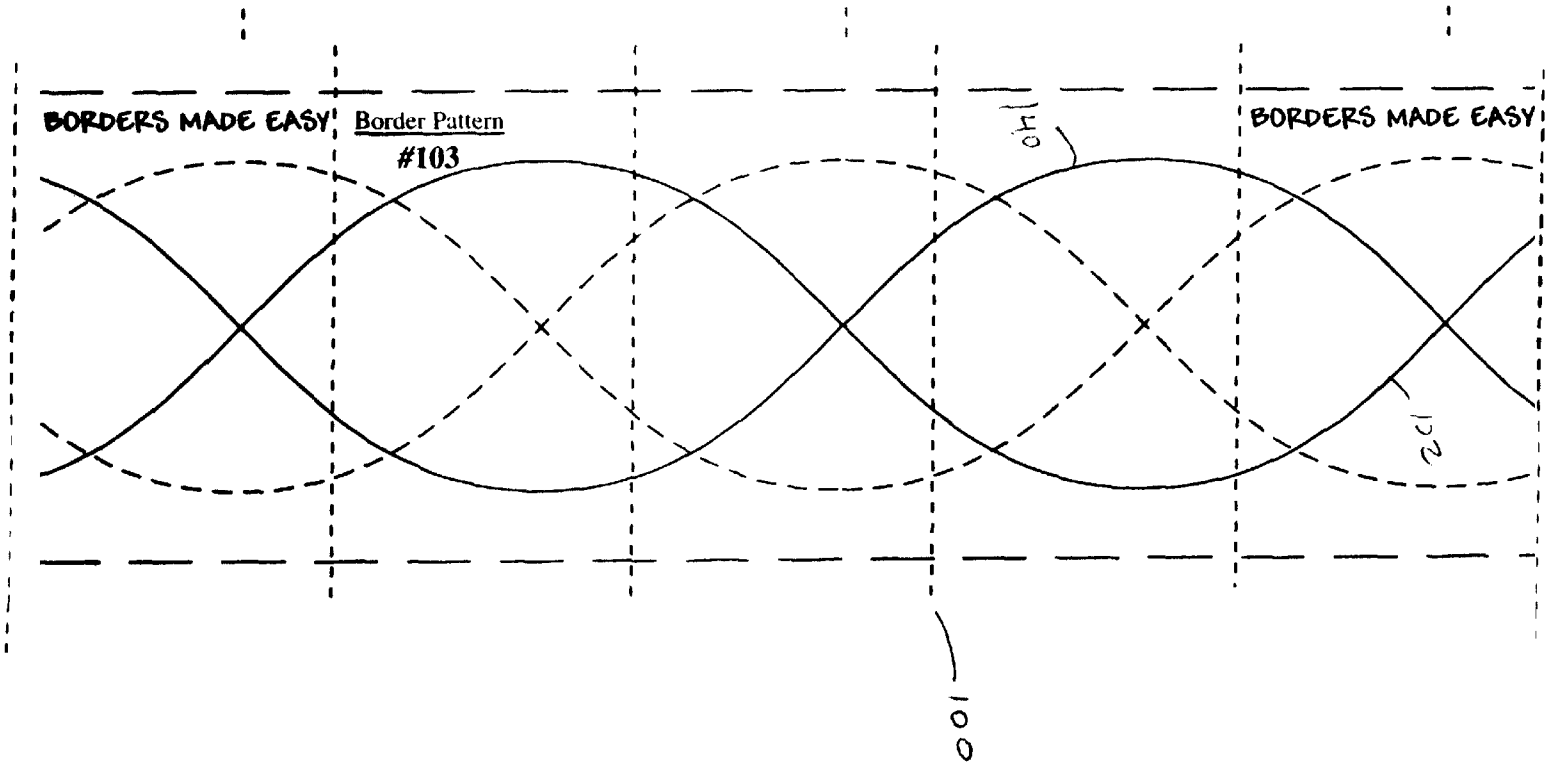
Figure 5:
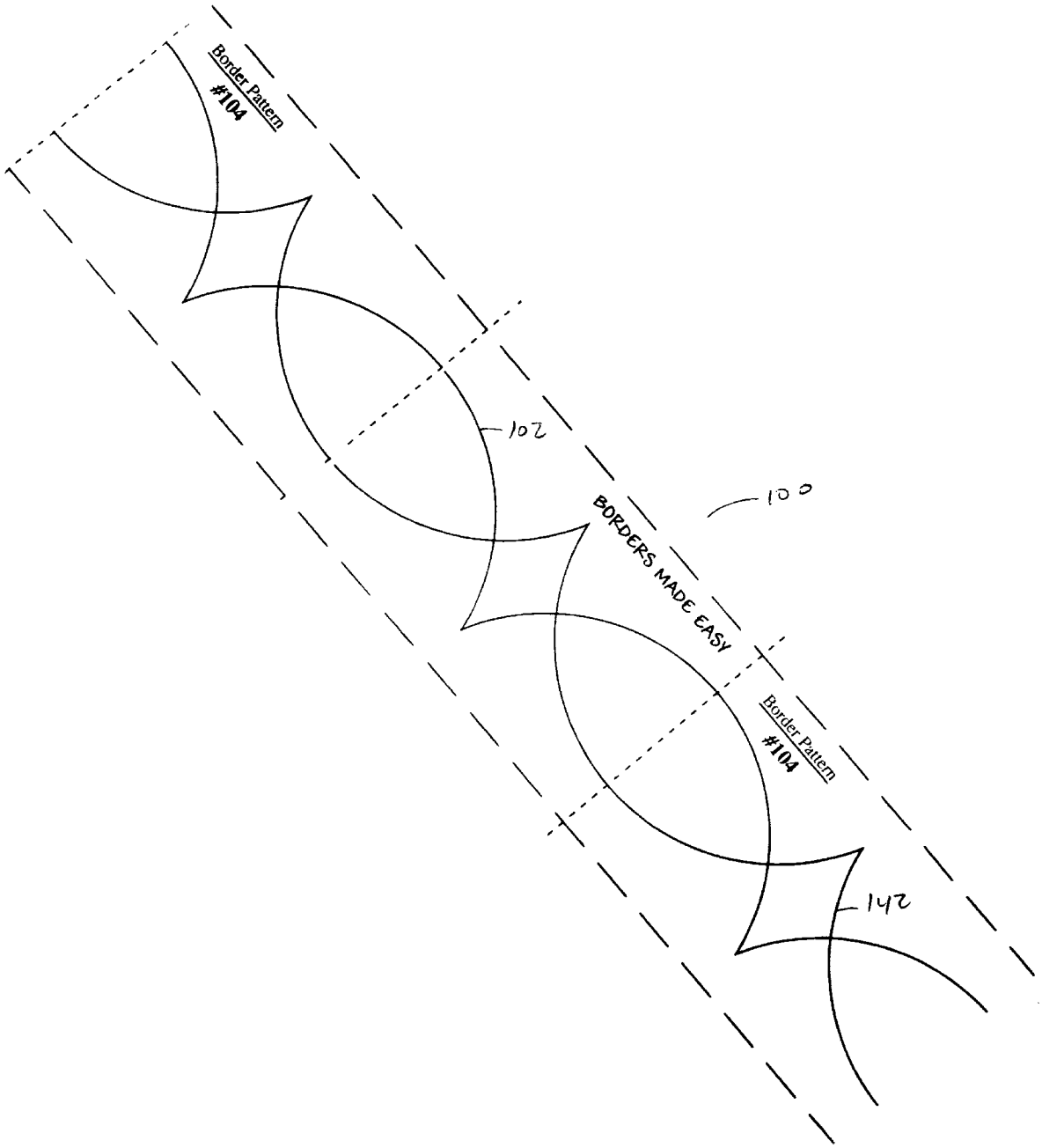
Figure 7:
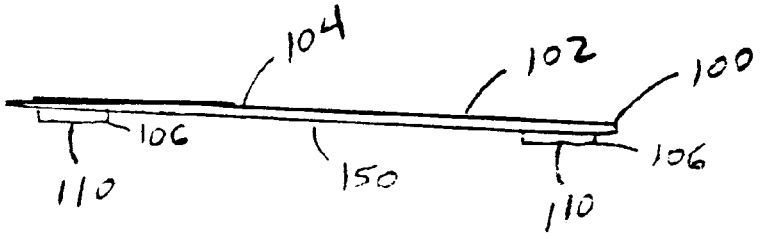
FIG. 7 illustrates a cross sectional view of the removable border of FIG. 1.

FIG. 1 illustrates a quilting border 100 used in a method of the present invention. The method includes preparing a quilt 300 for quilting on a substantially flat surface, layering a backing, a batting, and a quilt 300 top, optionally extending the backing and batting in the range of about 1.5 inches to about 2 inches beyond an edge of the quilt 300 top, basting or pinning the backing, batting and quilt 300 top, quilting a center area of the quilt, the basting step being optionally in the range of 0.25 inches to about 0.5 inches from the edge of the quilt 300 top, pinning corner pattern 200 at two adjacent corners of the quilt 300 top, measuring and cutting a removable border pattern 100 having border pattern indicia 102 on a top surface 104 of the removable border pattern 100 and at least two substantially parallel removable self-adhesive strips 106 on a bottom surface 150 of the removable border pattern 100 to a size to fit between the corner pattern 202, aligning the border pattern 102 to be substantially aligned with the corner pattern 202, removing a covering 110 from the removable self-adhesive strips 106, applying the removable border pattern 100 to the quilt 300 at quilt 300 in desired location, stitching the removable border 100 along the indicia 102, 202, and removing the removable border pattern 100 from the quilt. Removable border pattern 100 is made from paper in a preferred embodiment. However, any material such as a thin plastic film, that is easily removed after being stitched through can be used with the invention.

Removable border pattern 100 has indicia thereon indicating margin widths 120. Removable border pattern 100 can also indicate a splicing line 122 (including a plurality of such lines) that assist a user with cutting the border so that indicia 102 to line up with indicia 202.

In one embodiment, border 100 has sinusoidal, repeating indicia patterns 140 thereon. In a variant, a modified sinusoidal or nonsinusoidal pattern can be used 142.

A kit of parts for application of a quilting border 100 is also provided. The kit has at least four corner pattern 200 elements. Each corner pattern element 200 has corner border indicia 202 on at least one surface of the corner patterns 200, and a substantially continuous length of removable border pattern 100 having border pattern indicia 102 on a top surface 104 of the removable border pattern 100 and at least two substantially parallel removable self-adhesive strips 110 on a bottom surface 150 of the removable border pattern 100. The corner indicia 202 are arranged on the removable corner pattern 200 to be alignable with border pattern indicia 102.

Optionally, the corner border indicia 202 are of a size and character so that they are arranged thereon to be interchangeably applicable to any of the four corners of a quilt. In another embodiment, the corner border indicia 202 is arranged thereon to be applicable only to the left or right corners of a quilt.

The invention also provides a substantially continuous length of quilting border 100 pattern comprising border pattern indicia 102 on a top surface 104 of the quilting border 100 pattern and at least two substantially parallel removable self-adhesive strips 110 on a bottom surface 150 of the removable border pattern 100 optionally continuously arranged at edges of the quilting border 100 pattern. The border pattern indicia 102 are arranged in a substantially repeating manner and alignable with corner indicia 202 on a corner pattern 200.

Figure 8:
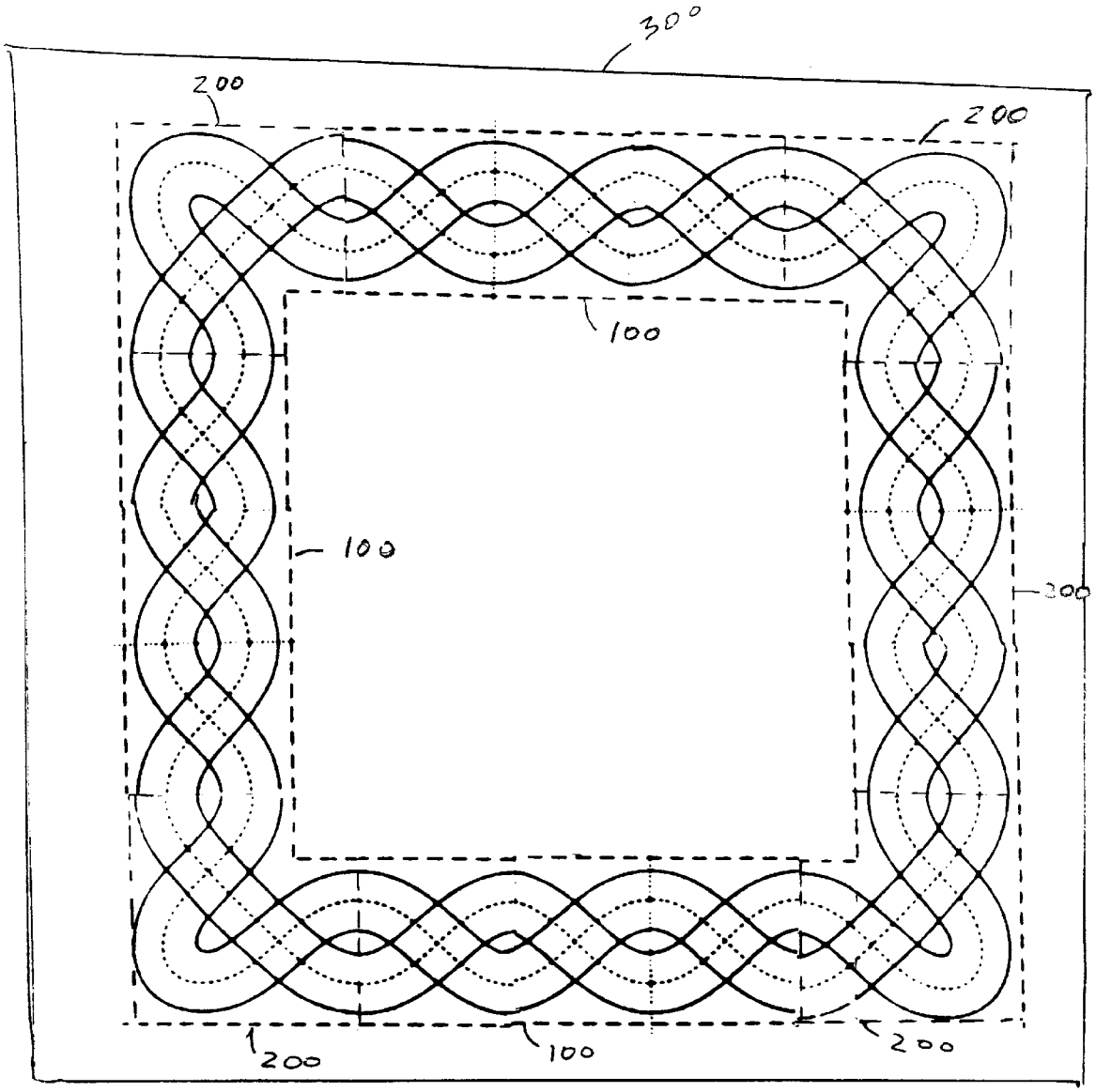
FIG. 8 shows a quilt of the present invention.

A quilt 300 is also provided herein. The quilt 300 is substantially in the shape of a geometric figure such as a square or a rectangle as shown in FIG. 8, however, the quilt can be in the shape of any known geometric figure, e.g. circle, parallelogram, etc. The quilt 300 includes at least four removable corner patterns 200 having corner indicia 202 thereon arranged substantially near the corners 302 of the geometric figure and at least four removable border patterns 100 having self-adhesive strips 110 thereon and border indicia 102. The border indicia 102 is in substantial alignment with the corner indicia 202.

Figure 9:
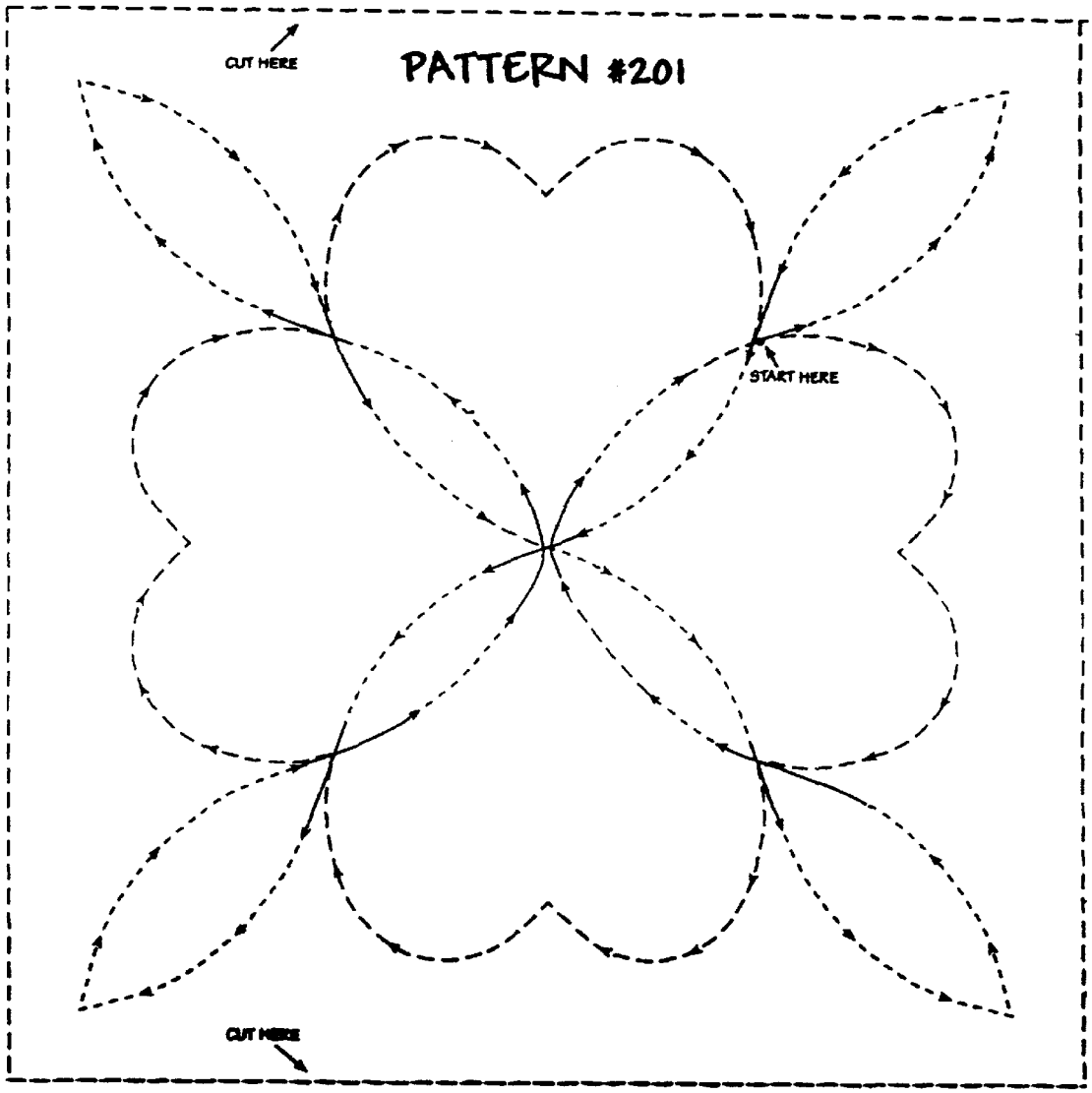
FIGS. 9–11 illustrate a block pattern of the present invention.
Figure 10:
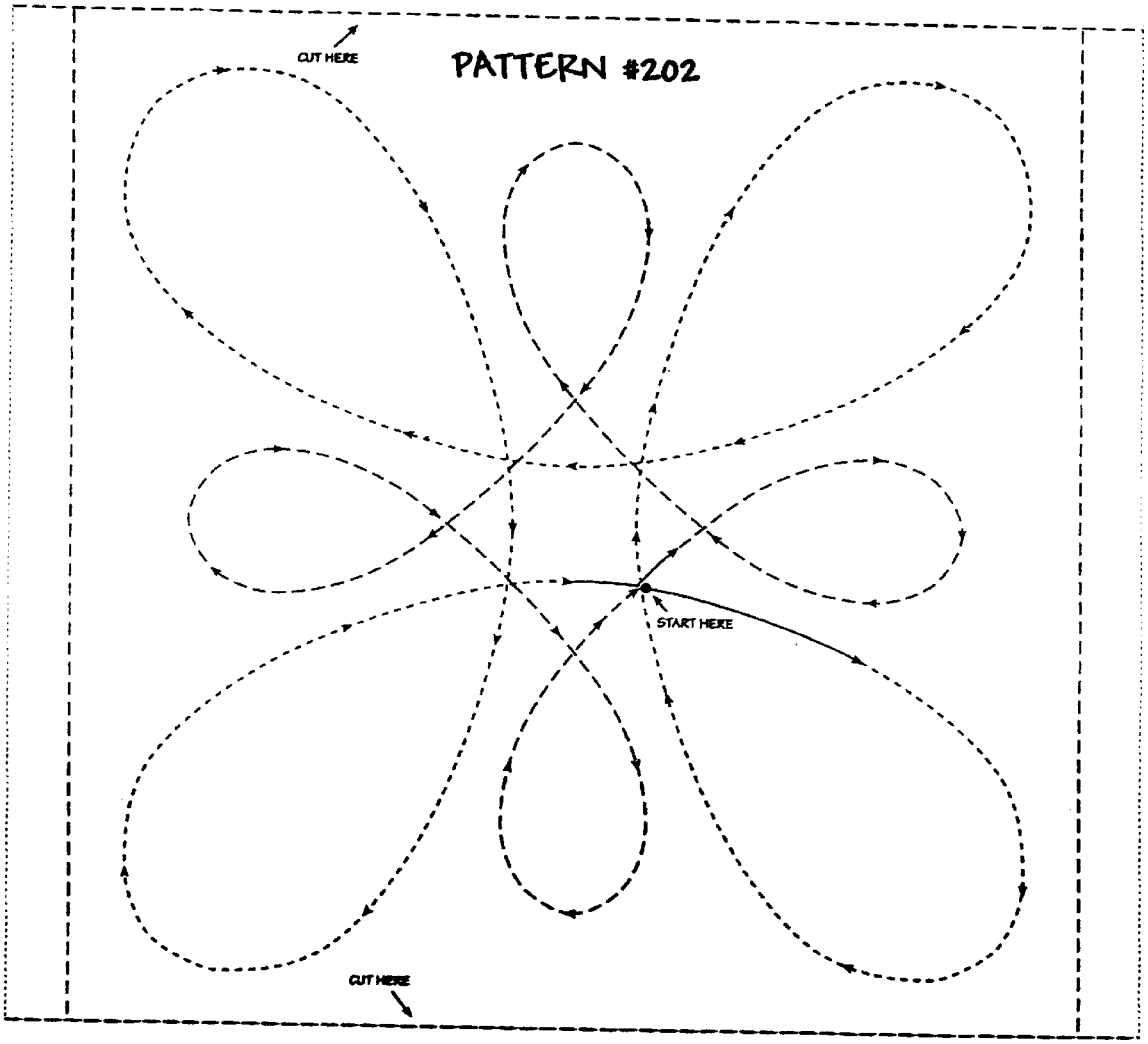
Figure 11:
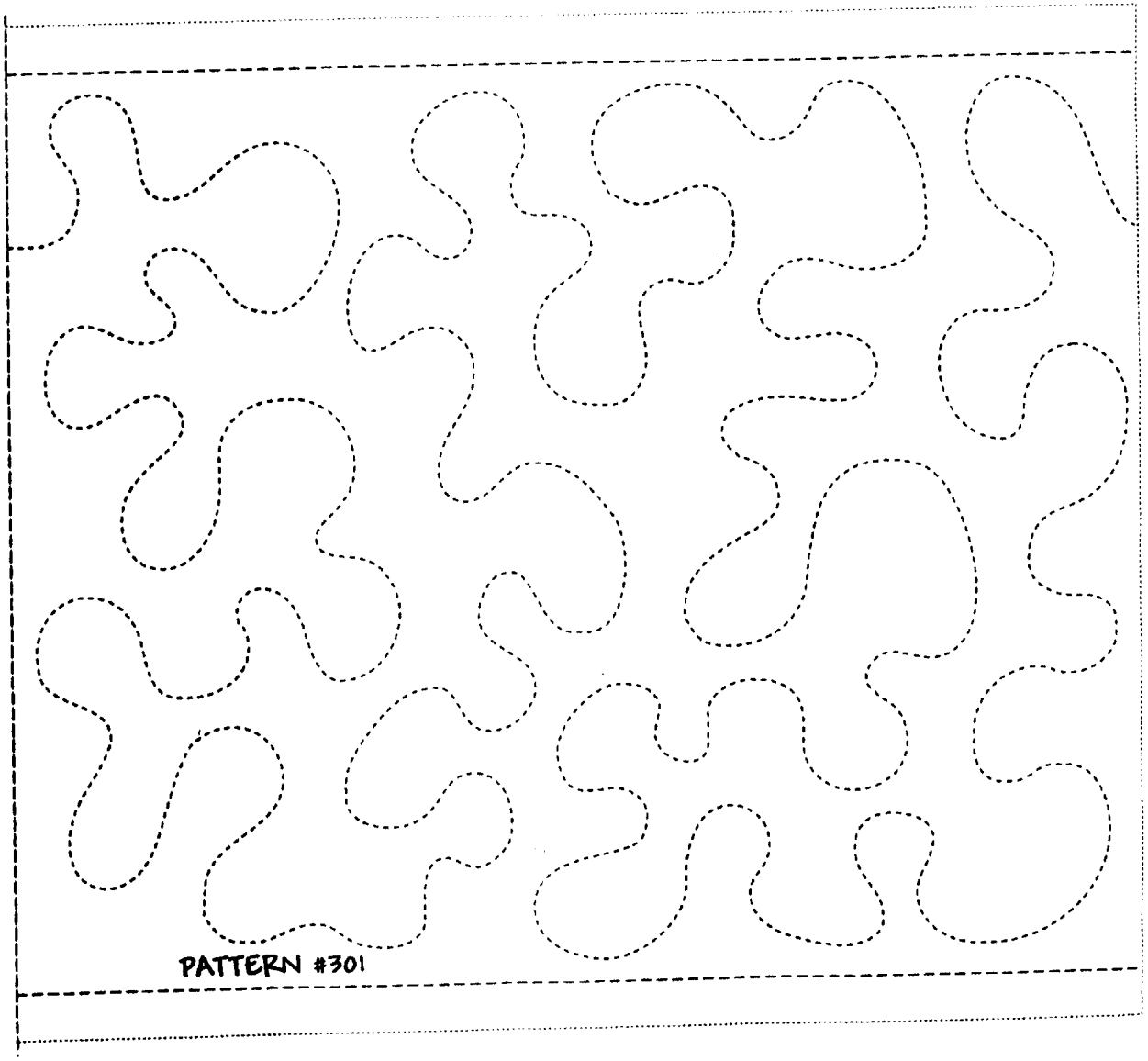

FIGS. 9–11 illustrate a block pattern that is used with the invention in the manner described above. The indicia indicate the manner and direction in which stitching is applied.

While only a few, preferred embodiments of the invention have been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

We claim:

1. A method of making a quilted border comprising preparing a quilt for quilting on a substantially flat surface; layering a backing, a batting, and a quilt top; optionally extending said backing and batting in the range of about 1.5 inches to about 2 inches beyond an edge of said quilt top; basting or pinning said backing, batting and quilt top; quilting a center area of said quilt, said basting step being optionally in the range of 0.25 inches to about 0.5 inches from said edge of said quilt top; pinning a corner pattern at two adjacent corners of said quilt top; measuring and cutting a removable border pattern having border pattern indicia on a top surface of said removable border pattern and at least one substantially parallel removable self-adhesive strips on a bottom surface of said removable border pattern to a size to fit between said corner patterns; aligning said border pattern indicia to be substantially aligned with said corner pattern indicia; removing a covering from said removable self-adhesive strips; applying said removable border pattern to said quilt at desired location; stitching said removable border along said indicia; and, removing said removable border pattern from said quilt.

2. The method in accordance with claim 1 in which said removable border pattern is made from paper.

3. The method in accordance with claim 1 in which said removable border paper has indicia thereon indicating a margin width.

4. The method in accordance with claim 1 in which said removable border has sinusoidal or nonsinusoidal indicia patterns thereon.

5. The method of claim 1 in which there are at least two substantially parallel removable self-adhesive strips on said bottom surface.

6. A kit of parts for application of a quilted border, comprising at least four corner patterns having corner border indicia on at least one surface of said corner patterns, and a substantially continuous length of removable border pattern having border pattern indicia on a top surface of said removable border pattern and at least one substantially parallel removable self-adhesive strips on a bottom surface of said removable border pattern, said corner indicia being arranged on said removable border pattern to be alignable with border pattern indicia.

7. The kit of claim 6 in which said removable border is constructed of a material that can be readily torn away from a quilt after stitching through said removable border pattern.

8. The kit of claim 6 in which said removable border is made of a paper.

9. The kit of claim 6 in which said indicia is printed on said removable border and said corner patterns.

10. The kit of claim 6 in which said corner border indicia is arranged thereon to be interchangeably applicable to any of the four corners of a quilt.

11. The kit of claim 6 in which said corner border indicia is arranged thereon to be applicable only to the left or right corners of a quilt.

12. The kit of claim 6 in which there are at least two substantially parallel removable self-adhesive strips on said bottom surface.

13. A substantially continuous length of quilting border pattern comprising border pattern indicia on a top surface of said quilting border pattern and at least one substantially parallel removable self-adhesive strips on a bottom surface of said removable border pattern optimally continuously arranged at edges of said quilting border pattern, said border pattern indicia being arranged in a substantially repeating manner and alignable with corner indicia on a corner pattern.

14. The substantially continuous length of quilting border pattern of claim 13 in which said removable border is constructed of a material that can be readily torn away from a quilt after stitching through said removable border pattern.

15. The substantially continuous length of quilting border pattern of claim 13 in which said removable border is made of a paper.

16. The substantially continuous length of quilting border pattern of claim 13 in which said indicia is printed on said removable border and said corner patterns.

17. The quilting border pattern of claim 13 in which there are at least two substantially parallel removable self-adhesive strips on said bottom surface.

18. A quilt being substantially in the shape of a geometric figure comprising at least four removable corner patterns having corner indicia thereon arranged substantially near the corners of said geometric figure and at least four removable border patterns having self-adhesive strips thereon and border indicia, said border indicia being in substantial alignment with said corner indicia.

* * * * *